United States Patent [19]

Lovgren et al.

[11] Patent Number: 4,475,271

[45] Date of Patent: Oct. 9, 1984

[54] PROCESS AND APPARATUS FOR PRODUCING UNIFORM FIBROUS WEB AT HIGH RATE OF SPEED

[75] Inventors: Ernest G. Lovgren, Palos Park, Ill.; Prashant K. Goyal, Princeton Junction, N.J.

[73] Assignee: Chicopee, New Brunswick, N.J.

[21] Appl. No.: 373,083

[22] Filed: Apr. 29, 1982

[51] Int. Cl.[3] ..... D01G 15/40; D01G 15/46

[52] U.S. Cl. ..... 19/105; 19/106 R; 19/145.7; 19/304

[58] Field of Search ..... 19/106 R, 145.5, 145.7, 19/296, 304, 306, 305, 105, 104, 106 P

[56] References Cited

U.S. PATENT DOCUMENTS

| | | | |
|---|---|---|---|
| 3,256,569 | 6/1966 | Draving | 19/106 R |
| 3,402,432 | 9/1968 | Kalwaites | 19/104 |
| 3,740,797 | 6/1973 | Farrington | 19/145.5 X |
| 3,768,118 | 10/1973 | Ruffo et al. | 19/145.5 X |
| 3,772,739 | 11/1973 | Lovgren | 19/145.5 X |
| 3,862,472 | 1/1975 | Norton | 19/305 |
| 3,996,731 | 12/1976 | Koella | 19/105 X |
| 4,064,600 | 12/1977 | Gotchel et al. | 19/306 |
| 4,097,965 | 7/1978 | Gotchel et al. | 19/306 |
| 4,130,915 | 12/1978 | Gotchel et al. | 19/304 |
| 4,258,454 | 3/1981 | Wilson et al. | 19/105 |
| 4,315,347 | 2/1982 | Austin et al. | 19/145.7 |

*Primary Examiner*—Louis Rimrodt

*Attorney, Agent, or Firm*—Nancy A. Bird; Charles J. Metz

[57] ABSTRACT

A method and apparatus is disclosed for producing high quality fibrous webs at high rates of speed. Fibers are fed to a rotating lickerin for opening, then to a rotating card cylinder for individualizing, and are then doffed into an air stream from which the fibers are condensed, as on a moving foraminous belt.

17 Claims, 4 Drawing Figures

PROCESS AND APPARATUS FOR PRODUCING UNIFORM FIBROUS WEB AT HIGH RATE OF SPEED

The invention relates to a process and an apparatus for producing uniform fibrous webs at high rates of speed.

BACKGROUND OF THE INVENTION

In the manufacture of nonwoven fabrics, fibrous webs comprising loose arrays of fibers are subjected to various procedures for bonding, rearranging, and/or interlocking of the fibers. The quality of the nonwoven fabric product is heavily dependent upon the quality of the fibrous web feed. Thus, weight, orientation of fibers, and uniformity of the product are functions of the corresponding properties of the feed web. Further, the speed at which the feed web can be produced has a significant influence on the economics of the process for producing the nonwoven fabric. Other things being equal, processing cost per unit is inversly proportional to throughput rate. For this reason, there is considerable economic incentive for developing high speed web-forming capabilities.

The present invention provides a process and apparatus that can produce fibrous webs, including very light weight webs, of excellent uniformity at extremely high rates of speed, thereby providing the means for simultaneous unit cost reduction and quality improvement in nonwoven processes which utilize the invention.

The invention comprises a combination of elements, each of which can be optimized to perform its assigned task(s) effectively and efficiently so that the invention can be employed to produce fibrous webs of at least as high quality as any fibrous webs that could be produced by the known prior art, and at the same time, such high quality webs can be produced at throughput rates unattainable by the prior art.

BRIEF SUMMARY OF THE INVENTION

The invention provides a method for producing a highly uniform web of fibers at high rates of speed, said method comprising the steps of:

(1) feeding an array of fibers to a rotating toothed roll adapted to open fibers, such as a rotating lickerin, to open the fibers;

(2) feeding the opened fibers from said toothed roll to the surface of a rotating toothed cylinder at a first position;

(3) carrying the fibers around the periphery of the cylinder from the first position to a second position spaced a predetermined distance around the periphery from the first position, wherein during at least a portion of the predetermined distance the fibers are brought into operative contact with combing means to individualize the fibers;

(4) substantially uniformly dispersing the individualized fibers from the rotating toothed cylinder at the second position into an air stream that is flowing past the periphery of the rotating cylinder at the second position, the air stream being characterized by:

(a) a velocity at the second position that is sufficient to maintain a substantially uniform dispersion of the fibers in the air stream;

(b) being substantially tangential to the periphery of the cylinder at the second position; and (c) being concurrent with the direction of rotation of the cylinder at the second position;

(5) carrying the dispersed fibers in the air stream until the fibers contact moving foraminous condensing means; and (6) allowing the air to pass through the condensing means while collecting the fibers on the condensing means in the form of a web of fibers, the web being characterized by excellent uniformity.

The invention also provides an apparatus for producing a highly uniform web of fibers at high rates of speed, the apparatus comprising, in combination:

(a) a rotatably mounted cylinder having a toothed peripheral surface and first and second positions on said surface separated by an arc;

(b) means for rotating the cylinder in a predetermined direction from the first to the second position at a predetermined rotational velocity;

(c) combing means in proximity to the peripheral surface along at least a portion of the arc;

(d) feed means including a rotatably mounted toothed roll adapted to open fibers, such as a lickerin, for feeding opened fibers to the peripheral surface at the first position;

the cylinder and the combing means being arranged and constructed so that when the opened fibers are fed to the peripheral surface of the cylinder at the first position, and the cylinder is rotated in the predetermined direction such that the fibers are carried on the peripheral surface from the first position past the combing means, the combing means and the toothed peripheral surface cooperate to individualize the fibers;

(e) air flow means for generating and directing a flow of air substantially tangentially to the peripheral surface of the cylinder at the second position on the peripheral surface, the flow of air being substantially concurrent with the predetermined direction at the second position, and the velocity of the flow of air being sufficient to maintain a substantially uniform dispersion of the fibers in the flow of air;

the air flow means and the cylinder being arranged and constructed such that the fibers are dispersed in the flow of air at the second position; and (f) moving fiber condensing means located in the air stream downstream from the second position;

whereby a highly uniform web of fibers is produced on the fiber condensing means.

THE PRIOR ART

In U.S. Pat. Nos. 3,740,797; 3,768,118; 3,772,739; and 4,018,646, there are disclosed various versions of a fibrous web forming apparatus referred to collectively as the "Dual Rotor". The Dual Rotor comprises a pair of oppositely rotating lickerins with means for feeding fibers to the lickerins. The fibers are doffed from the lickerins by a combination of centrifugal force and an air stream. The doffed fibers are condensed, as on a moving screen, downstream from the doffing point.

Zafiroglu, in U.S. Pat. No. 3,797,074, discloses fibrous web forming apparatus including a toothed disperser roll, a feed roll for feeding fibers to the roll, an airstream into which the fibers are doffed from the roll by centrifugal force, and fiber condensing means downstream from the doffing point.

Wood, in U.S. Pat. Nos. 3,768,119 and 3,972,092, discloses the doffing of fibers from a rotating lickerin into an air stream, from which the fibers are condensed to form a fibrous web. This apparatus is an improvement on the "Rando Webber", which is described by Langdon et al. in U.S. Pat. No. 2,890,497.

Gotchel et al., in U.S. Pat. No. 4,097,965, disclose fibrous web forming apparatus including a rotating toothed cylinder that carries fibers past one or more sets of rotating toothed satellite rolls (i.e., worker and stripper rolls) to a doffing area. An air stream is employed to keep the fibers on the surface of the cylinder until the desired doffing point is reached, at which the fibers are doffed into the air stream. The apparatus is especially designed for making webs of a mixture of pulp fibers and staple fibers. In the doffing zone, the pulp fibers are doffed at one point, and at least some of the staple fibers are doffed at a later point.

The Gotchel et al. apparatus is an adaptation of the Fehrer apparatus, described in U.S. Pat. No. 3,641,628. In Cols. 1 and 2 of Fehrer, there is found a discussion of several prior art web forming devices wherein air nozzles or an air stream are employed to facilitate doffing from a card. The most relevant portion of this prior art discussion appears to be col. 1, lines 19–32, where there is described a card having:

> " . . . an air nozzle, which is disposed closely behind the material inlet and extends in the direction of rotation of the carding drum approximately tangentially thereto and facilitates the detaching of the fibers from the clothing on the carding drum. It has been found, however, that the use of [such] a carding drum does not result in a perfect uniformity of the web which has been made because a drum which is combed only adjacent to the material inlet does not result in a fine disintegration of the material."

Although it is difficult to determine with certainty because the description is quite brief, the apparatus that Fehrer is referring to here appears to be similar in its relevance to this invention to the Dual Rotor and the Zafiroglu devices, which were discussed above.

Kennette et al., in U.S. Pat. No. 2,731,679, disclose an apparatus whereby carded fibers are doffed onto a conventional doffing cylinder, and are then doffed from the doffing cylinder into an airstream, from which the fibers are condensed on a moving foraminous condenser. The fibers on the doffer are in the form of a web, so that when the fibers are removed therefrom into the air stream, they are not individualized.

DETAILED DESCRIPTION OF THE INVENTION

Figure 1:
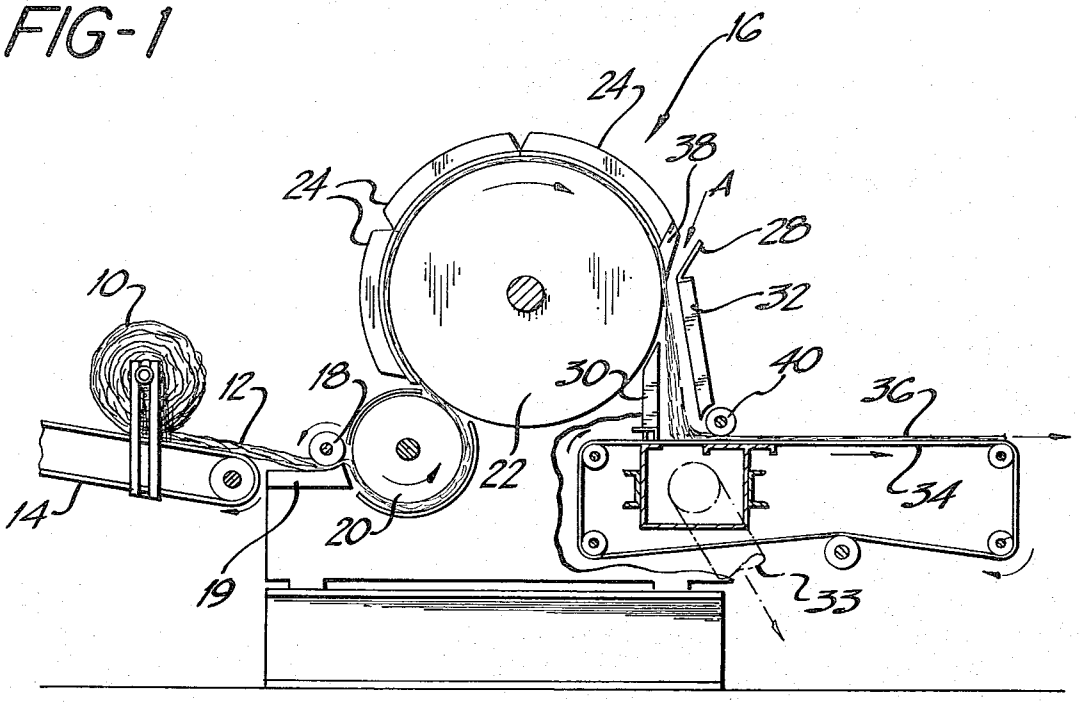
FIG. 1 is a side elevation, partially schematic, of an arrangement of apparatus comprising one embodiment of the invention.
Figure 2:
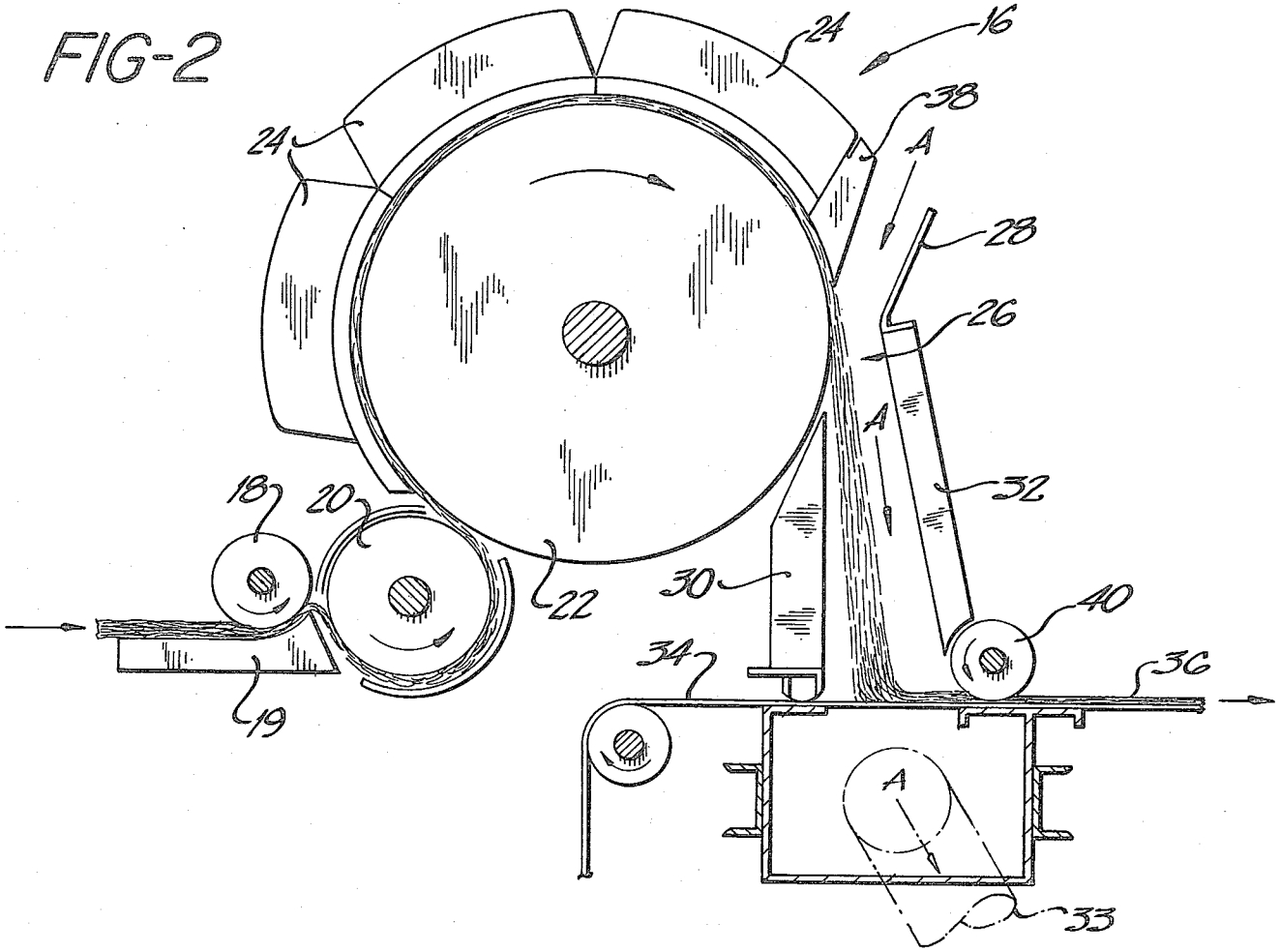
FIG. 2 is an enlarged and more detailed view of a portion of FIG. 1, showing particularly the cylinder and associated parts.

Referring to FIGS. 1 and 2, the embodiment shown includes a rotatably mounted roll 10 of a batt of staple fibers 12 and a conveyor belt 14 for conveying the fibers 12 from the roll 10 to the web forming apparatus of the invention, shown generally as 16. The fibers 12 are carried by a conveyor belt 14 to a feed roll 18, which feeds and meters the fibers past a nose bar 19 to a rotating lickerin 20, which is especially designed to open fibers from a fiber batt feed. The opened fibers are fed from the lickerin 20 to a cylinder 22, which is rotating in the direction shown. The surface of the cylinder 22 is covered with teeth that are especially designed to cooperate with combing means to individualize fibers.

The opened fibers are carried on the surface of the main cylinder 22 from the lickerin 20 past stationary card covers 24, that are equipped with means such as teeth that are adapted to cooperate with the toothed surface of the main cylinder 22 to individualize the fibers as the fibers are carried past the stationary card covers 24 to a doffing zone, shown generally in FIG. 2 as 26. By the time the fibers reach the doffing zone 26, they are individualized and form a uniform thin layer across the width of the cylinder 22. In the doffing zone 26, the fibers are doffed into an air stream that is flowing through a duct that is defined by the surfaces of a deflector plate 28, a doctor blade 30, a front duct plate 32 and side plates (not shown). The air stream flows in the direction of the arrows "A", past the rotating surface of the cylinder 22 at the doffing zone 26, and down through the duct that is formed by the deflector plate 28, doctor blade 30, front duct plate 32 and the side plates, through an endless, moving foraminous belt 34, and out through an exhaust duct 33. As shown in FIG. 1, the fibers that have been individualized on the cylinder 22 are doffed into the air stream in the duct and travel downwardly toward the endless, moving foraminous belt 34, on which the fibers condense to form a web 36. The web 36 is carried away from the condensing zone by the belt 34 for further processing.

The air stream flowing through the duct can be generated by an exhaust fan (not shown) adapted to suck air through the belt 34 and out through the exhaust duct 33. The velocity of the air stream is such that it is sufficient to keep the fibers uniformly dispersed therein. That is, the fibers are dispersed in the air stream in such a manner that the tendency for the fibers to clump or condense while they are in the air stream is minimized. As a general rule, this means that the air stream velocity is higher than the peripheral speed of the cylinder 22, and is therefore higher than the velocity of the fibers coming off the cylinder 22, so that the fibers are kept under tension until they reach the fiber condensing means. The air stream is travelling in a direction substantially tangential to the peripheral surface of the cylinder 22 at the doffing zone 26, and in a direction concurrent with the direction of rotation of the cylinder 22 at the doffing zone 26.

It is important for the successful practice of this invention that opened fibers be fed to the surface of the cylinder 22. The term "opened" fibers is intended to mean an array of fibers that is substantially free of clumps, tangles, ravels, knots, or other similar nonuniformities, but wherein there is still significant frictional interaction between the fibers. By "individualized" fibers, as opposed to opened fibers, is meant an array of fibers wherein there is substantially no mechanical or frictional interaction between the individual fibers in the array.

The preferred way to open the fibers for feeding to the surface of the cylinder 22 is by the use of a lickerin, as in the embodiment shown in FIGS. 1 and 2. However, the opening can be accomplished by other means, such as by the use of a card that is adapted to open rather than individualize fibers. The opened fibers from such a card would then be fed to the surface of the cylinder 22 by standard means such as by a feed roll-/nose bar combination.

At the doffing zone 26, the individualized fibers are doffed into the air stream. Doffing is accomplished by a combination of centrifugal force and the stripping forces generated by the air stream that is flowing past the peripheral surface of the cylinder 22.

For optimum performance of the invention, it is preferred that the centrifugally induced direction of the doffed fibers be such that the fibers are directed downstream in the duct in such a way that they would not tend to strike any of the stationary surfaces that describe the duct, such as the doctor blade 30 and front duct plate 32. To this end, it is desirable to employ means such as a trajectory control plate 38 for keeping the fibers on the surface of the rotating cylinder 22 until the desired doffing zone is reached, if the combing means does not extend to this point.

The fibers are kept on the surface of the rotating cylinder 22 by the card covers 24 and any extension thereof, such as the trajectory control plate 38. The fibers will tend to doff centrifugally as soon as they reach a point during the rotation of the cylinder 22 at which the cylinder 22 is uncovered. Actual doffing of the fibers begins within a few degrees of the point at which the cylinder 22 is uncovered, and extends in a narrow band not more than a few degrees in breadth.

The direction of doffing is essentially tangential at the point of release of the fiber. There will be a slight spread in the doffing directions of the fibers owing to the fact that the doffing occurs in a narrow band, as discussed above. This slight spread is beneficial because it helps to achieve a more uniform dispersion of fibers in the air stream.

The primary function of the air stream is to uniformly disperse the doffed fibers until the fibers are condensed. The several described characteristics of the air stream are important for this purpose. For instance, the fact that the air stream is concurrent with the direction of rotation of the cylinder 22 at the doffing zone, and is also substantially tangential to the periphery of the cylinder at the doffing zone, means that the centrifugally ejected fibers need not undergo any significant change of direction after being doffed, which could cause fiber clumping or other non-uniformities. Similarly, the velocity of the air stream is sufficient to maintain the fibers in a uniform dispersion. This is accomplished preferably by an air stream velocity higher than the peripheral speed of the rotating cylinder 22 (and hence higher than the velocity of the doffed fibers), which will tend to maintain the fibers under a slight tension until they are condensed.

It is preferred that the velocity of the air stream in the duct be such that the Reynolds number of the air flow is in the turbulent range. With such turbulent flow, except for narrow boundary layers at the sides, the side-to-side velocity profile of the air stream is quite flat, which encourages side-to-side uniformity of the web being formed. Laminar flow has a more curved velocity profile, which would tend to encourage thicker fiber deposition in the center of the web than at the two sides. It is highly preferred that the duct be uniform, have smooth walls, and have no sudden discontinuities, in order to promote a uniform flow of air through the duct.

Fibers of all types can be employed in the invention, although it is particularly adapted for use with staple fibers. Staple fibers are those having lengths that usually range from about one-half inch up to about three inches or more. All types of staple fibers can be used, including rayon, polyester, polypropylene, cotton, bicomponent fibers, mixtures thereof, and the like. Also, if desired, shorter fibers can be employed, either alone or in admixture with staple fibers.

Figure 3:
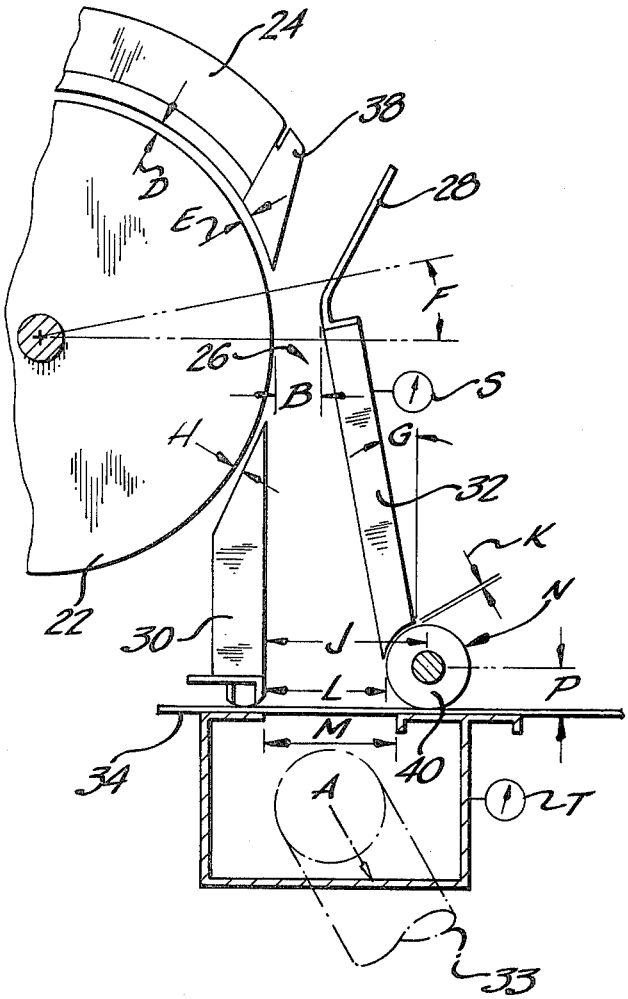
FIG. 3 is a detailed view of the doffing zone, duct means, and fiber condensing area.

Referring now most specifically to FIGS. 2 and 3, a specific embodiment of an apparatus in accordance with the invention is described, along with typical processing conditions.

The feed roll 18 has a diameter of 10 centimeters. It is toothed, with 10 rows of teeth per axial inch and 5 teeth to the inch around the circumference of the roll. The teeth are 0.145 inch high and have 10° of negative rake.

The lickerin 20 is a cylinder having a diameter of 25 centimeters. There are 12 rows of teeth per axial inch of the lickerin and 5 teeth per inch around the circumference. The teeth have 15° of positive rake, and are 0.215 inch high.

The cylinder 22 has a diameter of 60 centimeters. There are 28 rows of teeth per axial inch of the cylinder 22, and 14 teeth per inch around the circumference. The teeth have 15° of positive rake and are 0.123 inch high.

There are three stationary card covers 24 extending over a total arc of about 230°. There are 28 rows of teeth per inch of width of the covers 24 and 20 teeth per inch along the direction of travel of the cylinder 22. The individual teeth are 0.123 inch high and have 10° of positive rake.

The term "positive rake", referring to the teeth on the lickerin and cylinder, means a rake that is slanted or angled in the direction of travel of the fibers. Conversely, the term "negative rake" refers to teeth that are slanted opposite to the direction of travel of the fibers.

The several variables shown in FIG. 3 are the following:

"B" is the distance between the top of the front duct plate 32 and the surface of the cylinder 22, and is of the order of about one-quarter inch to about one inch, preferably about one-half inch, for the operating conditions that are discussed below.

"D" refers to the space between the tips of the teeth on the peripheral surface of the cylinder 22 and the tips of the teeth on the inside surface of the stationary card covers 24, and is of the order of about 0.01 to about 0.025 inch.

"E" refers to the distance between the surface of the cylinder 22 and the inner surface of the trajectory control plate 38, and can vary from about 0.01 to about 0.06 inch, in those cases where this plate 38 is employed.

"F" refers to the angle made by a horizontal line extending through the center point of the cylinder 22 and a second line that extends from the center point of the cylinder 22 through the point at which the cylinder 22 is uncovered (i.e., through the end of the trajectory control plate 38). The location of this point determines the fiber doffing zone. Typically, "F" can vary from 0 to about 10°, and is preferably about 2½°, for an arrangement of apparatus such as that shown in these drawings, when operated under the conditions discussed below.

"G" refers to the angle from the vertical of the front shield 32, and is preferably about 5° (as shown), but can vary, for instance, from about −3° to about +12°. The setting of this angle "G" is important. ("G" would normally be changed by varying the dimension "L", rather than by making any significant changes in the dimension "B".) If the angle "G" is too large, the air flow will tend to slow down as it approaches the condenser. In that case, the fibers in the airstream could tend to clump or agglomerate and eddy currents could develop. Both of these factors would have an adverse impact on the uniformity of the web product. Routine experimentation will suffice to determine the preferred angle "G" in particular cases.

"H" refers to the space between the tips of the teeth on surface of the cylinder 22 and the doctor blade 30. This distance is not narrowly critical. Typically, it is from about 0.010 inch to about 0.060 inch, and is preferably about 0.030 inch.

"J" refers to the distance between the surface of the doctor blade 30 and the center of a rotatably mounted roll 40, which serves only to seal the bottom front portion of the duct below the front duct plate 32. In the embodiment shown, the dimension "J" is about 3½ inches.

"K" refers to the clearance between the roll 40 and the front duct plate 32, and is of the order of up to about 0.030 inch, and preferably from about 0.005 to 0.015 inch.

"L" refers to the distance between the doctor blade 30 and the bottom of the front shield 32, and when the angle G is 5°, this dimension will be about 1 11/16 inches.

"M" refers to the width of the opening of the vacuum duct beneath the belt 34, and is of the order of about 3⅛ inch in the embodiment shown.

"N" refers to the diameter of the roll 40, and in the embodiment shown is about 3½ inches.

The dimension "P" refers to the distance from the center line of the roll 40 to the top of the belt 34, and will vary depending upon the weight of the fibrous web being produced, but in general will be from about 1½ to about 1¾ inches.

The rotational speed of the cylinder 22 is of the order of from about 600 to about 2000 rpm, which translates to a peripheral speed of from about 3700 to about 12,400 feet per minute for the cylinder having a diameter of 60 centimeters.

"S" and "T" refer to vacuum gauge readings, which can be up to, for instance, about 42 inches of water vacuum, with an air stream volume of up to about 4,000 cubic feet per minute. At a volume of 4,000 cubic feet per minute, with an apparatus arranged as shown in FIG. 3 with the preferred settings and dimensions described herein, and, having a width of 40 inches, a maximum air speed at the doffing point of about 28,000 feet per minute was measured.

An important feature of the invention is that each major element of the apparatus of the invention can be designed to perform only one task, and can therefore be optimized to perform that one task efficiently and effectively. Thus, the lickerin is required only to open fibers from a fiber batt feed, and the main cylinder/combing means combination is required only to individualize fibers. In contrast, the Dual Rotor, the Zafiroglu web forming apparatus, the Rando Webber of Wood and Langdon et al., and the Fehrer card, all employ a single main cylinder that is used both to open and to individualize the fibers. (The Dual Rotor actually uses two main cylinders. But since they act in parallel, the point being made here applies to the Dual Rotor as well as to the other prior art devices mentioned.) We have found that the combination of a lickerin, optimized for opening, and a card cylinder/combing means combination, optimized for individualizing, results in unexpectedly high efficiencies. As a result, the apparatus of this invention can produce webs of excellent quality at very high rates of speed. For instance, the apparatus of this invention has made lightweight (i.e., ¼ to ½ ounces per square yard) rayon 1½ denier, (1 9/16 inch staple fiber webs of excellent quality at a rate of up to 25 pounds/hour/inch of width of the cylinder (the higher throughput rates were achieved with the 1½ ounce webs), without reaching the point at which web quality begins to suffer. The normal maximum throughput rates for making similar lightweight rayon staple fiber webs (from similar 1½ denier rayon staple fiber) for a conventional card is about 5 pounds/hour/inch of width, for a Rando Webber, about 4 to 5 pounds/hour/inch of width, and for a Dual Rotor, about 4 to 6 pounds/hour/inch of width/-cylinder. Above these throughput rates, web quality begins to suffer, as evidenced by poorer uniformity and increased fiber breakage.

The term "web quality," as used herein, refers principally to uniformity. However, the webs produced by this invention can exhibit excellent qualities in other ways also. For instance, one measure of the efficiency of a web forming device of the type contemplated here is the degree to which fibers can be processed by it without breaking. Some breaking is bound to occur, but if it is kept to a minimum, then to that degree the quality of the webs produced thereby will be improved. To illustrate the reduced fiber breakage that can be obtained by this invention, 1½ denier, 1 9/16 inch, polyester staple fiber webs were produced by the process and apparatus of this invention, and by a Dual Rotor (operating with one rotor only), both at web forming rates of 3.8 pounds/hour/inch of width, which is approaching the maximum output rate at which the Dual Rotor can be operated and still maintain good quality webs. Both webs were then subjected to analysis for fiber length, with the results being displayed below in Table I:

TABLE I

| Fiber Length, inches | Fiber Length Analysis Cumulative Percentage | | | |
|---|---|---|---|---|
| | Feed | This Invention | Feed | Dual Rotor |
| 19/16 | 36.5 | 30.8 | 38.0 | 0 |
| 17/16 | 47.2 | 40.9 | 50.8 | 9.5 |
| 15/16 | 57.8 | 51.9 | 62.4 | 21.7 |
| 13/16 | 68.0 | 62.9 | 72.7 | 36.9 |
| 11/16 | 77.4 | 73.5 | 81.5 | 53.2 |
| 9/16 | 85.6 | 83.1 | 88.8 | 69.4 |
| 7/16 | 92.2 | 91.9 | 94.3 | 83.6 |
| 5/16 | 96.8 | 97.5 | 98.0 | 94.6 |
| 3/16 | 98.9 | 99.2 | 99.6 | 99.8 |
| 1/16 | 100.0 | 100.0 | 100.0 | 100.0 |

The reduction in fiber breaking is believed to be largely the result of the fact that the opening and the individualizing of the fibers are being accomplished separately, with parts that are designed specifically for just one purpose. It is not intended to imply that the Dual Rotor could not be run so as to also obtain such a low degree of fiber breakage. However, to do so, the Dual Rotor would have to be run at a very low output rate.

Another interesting aspect of this invention is that the individual fibers of the web products appear to be straighter than is the case with other web forming devices. This has been observed in the microscopic examination of a limited number of sample webs which contained tracer fibers. The reason for this is believed to be a combination of (a) the efficient combing that occurs as the fibers are carried past the combing means, and (b) the action of the air stream in maintaining the straightness of the fibers. The air stream does this by (a) maintaining the fibers under slight tension as they are carried from the doffing point to the condenser, (b) maintaining a uniform dispersion of the fibers (i.e., preventing the fibers from excessive contact with one another while in the air stream), and (c) minimizing contact of the fibers with the stationary surfaces that describe the duct in which the air stream flows.

Figure 4:
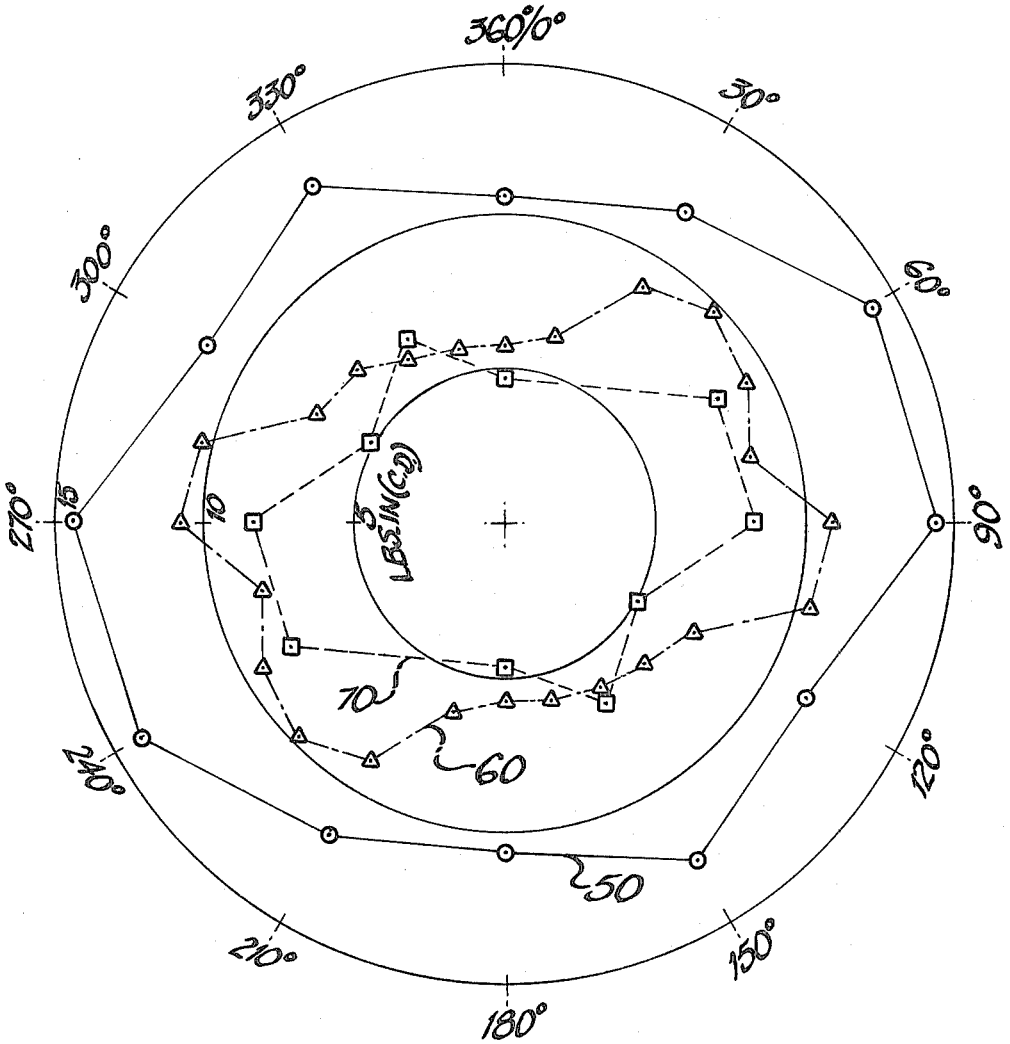
FIG. 4 is a polar diagram comparing the tensile strengths in various directions of bonded webs of this invention with bonded webs made by two prior art web forming devices.

A test was carried out that illustrates that the webs of this invention can be of higher quality than Dual Rotor webs and Rando Webber webs. The three web formers were used to make 1 ounce per square yard rayon staple fiber webs from Avtex rayon of 1½ denier, 1 9/16 inches long. The webs were then saturation bonded with 30 to 40 weight per cent (based on weight of fibers) of a stiff polyvinyl acetate latex (National Starch 2211). The level and type of binder was selected so that, under tension, the impregnated webs would fail by fiber breakage rather than by adhesive bond failure. Tensile specimens 1 inch wide by 6 inches long were then cut from each bonded web, with the specimens being oriented in the machine direction, in the cross direction, and at 30° intervals in between. In the graph shown as FIG. 4, the results of testing these specimens for tensile strength are displayed. The points plotted at 360°/0° and 180° were from the specimens that were oriented in the machine direction (i.e., with the long dimension in the tensile specimen being oriented in the machine direction); the points plotted at 90° and 270° were from the specimens that were oriented in the cross direction; and the other points were from specimens oriented as shown. Curve 50 represents the results from the web of this invention; Curve 60 represents the Dual Rotor web; and Curve 70 represents the Rando Webber web. It is apparent that the tensile strengths in all directions of the web of this invention were higher than those of the Dual Rotor and the Rando Webber webs.

The reason for the higher tensile strengths in all directions has not been determined with certainty, but one or more of the following factors are believed to contribute to it:

(a) Improved uniformity, which minimizes the adverse effects caused by localized areas that have lower fiber density;
(b) Reduced fiber breakage; and
(c) Straighter fibers in all directions, which could make possible the achieving of a higher proportion of the theoretical strength imparted by the fibers.

A number of different types of fibers have been formed into webs by the 40-inch wide apparatus described above with special reference to FIGS. 2 and 3. Three different types of feed webs have been tried (mostly with rayon and polyester staple), carded batts weighing from 1.3 to 17 ounces/yd$^2$, Rando Webber batts weighing from 4 to 17 oz/yd$^2$, and picker laps weighing from 16 to 20.7 oz/yd$^2$. The best quality webs were produced from the carded batts, with the Rando Webber batts being a close second. With rayon, a carded batt weighing about 7 oz/yd$^2$ seemed to be optimum, although no major change was noted above or below this weight. The following Table II displays the cylinder speeds (RPM) and vacuum gauge readings ("S" in FIG. 3), which were found to give best quality webs for various types of fibers:

TABLE II

| Fiber | RPM | "S", inches of water |
|---|---|---|
| Rayon, 1½ denier, 1 9/16 inches | 1500 | 30 |
| Polyester, 1½ denier, 1½ inches | 1500 | 38 |
| Polypropylene, 1.8 denier, and 1.5 denier, 1½ inches | 1000 | 38 |
| 50/50-Polyester/Polypropylene | 1000 | 38 |

Rayon webs weighing 1.4 oz/yd$^2$ were made at a speed of 517 feet/minute (equivalent to 25 pounds/hour/inch of cylinder width), and 2.7 oz/yd$^2$ polyester webs were made at 159 feet/minute (15 pounds/hour/inch), without reaching the maximum throughput rate.

The specific experimental conditions set forth above are intended solely as illustrations, and are not intended to be limiting.

A test to demonstrate the improved uniformity that can be obtained by the invention was carried out. Rayon staple fiber webs were made at the speeds indicated in Table III, below, by the apparatus of this invention, by the Dual Rotor, and by a Rando Webber. The webs were then evaluated for uniformity by the following weight distribution technique:

1. The web is cut into a rectangle 11 inches in the machine direction by 8½ inches in the cross direction, and is then placed between two pieces of onion skin paper for support;
2. The sample is folded to make six layers, with the fold lines running in the cross direction;
3. The folded webs are cut with a circular die ⅞-inch in diameter. Six cuts are made through the folded specimen to make 36 circular pieces from each sample;
4. The 36 cut pieces are weighed one at a time using a balance accurate to 0.1 milligram; and
5. The average weight, standard deviation, and variation coefficients of the 36 cut pieces are calculated.

The results are displayed in Table III:

TABLE III

| Web | Web Production speed, ft/min | Web Weight, oz/yd$^2$ | Variation Coefficient[1] |
|---|---|---|---|
| This | 150 | 1.0 | 6.8 |
| Invention | 150 | 1.0 | 7.2 |
| Dual | 150 | 1.0 | 12.2 |
| Rotor | 30 | 1.0 | 10.5 |
| Rando | 160 | 1.0 | 14.3 |
| Webber | 160 | 1.0 | 14.8 |
| | 68 | 0.8 | 16.6 |

[1]Variation coefficient is the standard deviation divided by the mean. A lower number indicates a lower degree of variation.

What is claimed is:

1. A process for producing a highly uniform web of fibers at high rates of speed, said method comprising the steps of:

(1) feeding an array of fibers to a rotating toothed roll adapted for opening fibers, to open the fibers;
(2) feeding the opened fibers from said rotating toothed roll to the surface of a rotating toothed cylinder at a first position;
(3) carrying the fibers around the periphery of said cylinder from said first position to a second position spaced a predetermined distance around said periphery from said first position, wherein during at least a portion of said predetermined distance said fibers are brought into operative contact with combing means to individualize said fibers;

(4) substantially uniformly dispersing the individualized fibers from the rotating toothed cylinder at said second position into an air stream that is flowing past the periphery of the rotating cylinder at said second position, said air stream being characterized by:

(a) a velocity at said second position that is sufficient to maintain a substantially uniform dispersion of the fibers in the air stream;

(b) being substantially tangential to the periphery of said cylinder at said second position; and (c) being concurrent with the direction of rotation of said cylinder at said second position;

(5) carrying the dispersed fibers in said air stream under tension until the fibers contact moving foraminous condensing means; and (6) allowing the air to pass through said condensing means while collecting the fibers on said condensing means in the form of a web of fibers, said web being characterized by excellent uniformity.

2. A process for producing a highly uniform web of fibers at high rates of speed, said method comprising the steps of:

(1) feeding an array of fibers to a rotating toothed roll adapted for opening fibers, to open the fibers;

(2) feeding the opened fibers from said rotating toothed roll to the surface of a rotating toothed cylinder at a first position;

(3) carrying the fibers around the periphery of said cylinder from said first position to a second position spaced a predetermined distance around said periphery from said first position, wherein during at least a portion of said predetermined distance said fibers are brought into operative contact with combing means to individualized said fibers;

(4) substantially uniformly dispersing the individualized fibers from the rotating toothed cylinder at said second position into an air stream that is flowing past the periphery of the rotating cylinder at said second position with a velocity greater than the peripheral speed of the rotating toothed cylinder, said air stream being characterized by:

(a) a velocity at said second position that is sufficient to maintain substantially uniform dispersion of the fibers in the air stream;

(b) being substantially tangential to the periphery of said cylinder at said second position; and (c) being concurrent with the direction of rotation of said cylinder at said second position;

(5) carrying the dispersed fibers in said air stream under tension unitl the fibers contact moving foraminous condensing means; and (6) allowing the air to pass through said condensing means while collecting the fibers on said condensing means in the form of a web of fibers, said web being characterized by excellent uniformity.

3. The process of claim 1 or 2 wherein said rotating toothed roll is a rotating lickerin.

4. The process of claim 3 wherein fibers are fed to said rotating lickerin from a feed roll/nose bar combination.

5. The process of claim 4 wherein the velocity of the air stream is such that the Reynold's number of the flowing air in the zone including the second position to the condensing means is in the turbulent range.

6. The process of claim 3 wherein the velocity of the air stream is such that the Reynold's number of the flowing air in the zone including the second position to the condensing means is in the turbulent range.

7. The process of claim 1 or 2 wherein the velocity of the air stream is such that the Reynold's number of the flowing air in the zone including the second position to the condensing means is in the turbulent range.

8. An apparatus for producing a highly uniform web of fibers at high rates of speed, said apparatus comprising, in combination:

(a) a rotatably mounted cylinder having a toothed peripheral surface and first and second positions on said surface separated by an arc;

(b) means for rotating said cylinder in a predetermined direction from said first to said second position at a predetermined rotational velocity;

(c) combing means in proximity to said peripheral surface along at least a portion of said arc;

(d) feed means including a rotatably mounted toothed roll adapted for opening fibers, for feeding opened fibers to said peripheral surface at said first position;

said cylinder and said combing means being arranged and constructed so that when said opened fibers are fed to the peripheral surface of said cylinder at said first position, and said cylinder is rotated in said predetermined direction such that said fibers are carried on said peripheral surface from said first position past said combing means, the combing means and said toothed peripheral surface cooperate to individualize said fibers;

(e) air flow means for generating and directing a flow of air substantially tangentially to the peripheral surface of said cylinder at said second position on said peripheral surface, said flow of air being substantially concurrent with said predetermined direction at said second position, and the velocity of said flow of air being sufficient to maintain a substantial uniform dispersion of the fibers under tension in said flow of air;

said air flow means and said cylinder being arranged and constructed such that said fibers are dispersed in said flow of air at said second position;

(f) moving fiber condensing means located in said flow of air downstream from said second position; whereby a highly uniform web of fibers is produced on said fiber condensing means.

9. The apparatus of claim 8 wherein said rotatably mounted toothed roll is a lickerin.

10. The apparatus of claim 9 including a feed roll/nose bar combination arranged and constructed to feed fibers to said rotatably mounted lickerin.

11. The apparatus of claim 8, 9 or 10 wherein the air flow means is arranged and constructed so as to provide a flow of air having a velocity greater than the peripheral speed of said cylinder when said cylinder is rotated at said predetermined rotational velocity.

12. The apparatus of claim 11 wherein the combing means comprises a concavely shaped member having teeth with a negative rake.

13. The apparatus of claim 12 wherein the air flow means is arranged and constructed so that the fibers dispersed in said air stream avoid any significant contact with any stationary surface until the fibers contact the fiber condensing means.

14. The apparatus of claim 11 wherein the air flow means is arranged and constructed so that the fibers dispersed in said air stream avoid any significant contact with any stationary surface until the fibers contact the fiber condensing means.

15. The apparatus of claim 8, 9 or 10 wherein the combing means comprises a concavely shaped member having teeth with a negative rake.

16. The apparatus of claim 15 wherein the air flow means is arranged and constructed so that the fibers dispersed in said air stream avoid any significant contact with any stationary surface until the fibers contact the fiber condensing means.

17. The apparatus of claim 8, 9, or 10 wherein the air flow means is arranged and constructed so that the fibers dispersed in said air stream avoid any significant contact with any stationary surface until the fibers contact the fiber condensing means.

* * * * *